US008608446B2

(12) United States Patent
Pickens et al.

(10) Patent No.: US 8,608,446 B2
(45) Date of Patent: Dec. 17, 2013

(54) ROTOR DISK AND BLADE ARRANGEMENT

(75) Inventors: John T. Pickens, Middletown, CT (US); Stanley J. Szymanski, Agawam, MA (US)

(73) Assignee: United Technologies Corporation, Hartford, CT (US)

( * ) Notice: Subject to any disclaimer, the term of this patent is extended or adjusted under 35 U.S.C. 154(b) by 1658 days.

(21) Appl. No.: 11/446,724

(22) Filed: Jun. 5, 2006

(65) Prior Publication Data

US 2007/0280831 A1 Dec. 6, 2007

(51) Int. Cl.
*F01D 5/32* (2006.01)

(52) U.S. Cl.
USPC ..... 416/215; 416/218; 416/248; 416/220 R; 29/889.21

(58) Field of Classification Search
USPC ..... 416/215–218, 219 R, 220 R, 221, 248; 29/889.21, 889.22
See application file for complete search history.

(56) References Cited

U.S. PATENT DOCUMENTS

| | | | | |
|---|---|---|---|---|
| 1,303,004 | A * | 5/1919 | Aldis | 416/216 |
| 1,687,891 | A * | 10/1928 | Ray | 416/216 |
| 2,315,631 | A * | 4/1943 | Lloyd et. al. | 416/216 |
| 2,631,004 | A * | 3/1953 | Swansen | 416/217 |
| 3,567,337 | A | 3/1971 | Zerlauth et al. | |
| 6,464,463 | B2 * | 10/2002 | Yvon Goga et al. | 416/215 |
| 6,752,598 | B2 * | 6/2004 | Antunes et al. | 416/215 |
| 2007/0014667 | A1 * | 1/2007 | Pickens et al. | 416/193 A |

FOREIGN PATENT DOCUMENTS

| | | | | |
|---|---|---|---|---|
| CH | 357414 | | 10/1961 | |
| DE | 2027861 | A * | 12/1971 | 416/218 |
| EP | 0081436 | | 6/1983 | |
| EP | 0210940 | | 2/1987 | |
| FR | 2664944 | | 1/1992 | |
| GB | 2156908 | | 10/1985 | |
| GB | 2171150 | | 8/1986 | |

OTHER PUBLICATIONS

European Search Report dated Dec. 14, 2010.
US H1258 H (Hindle Edmund H [US]) Dec. 7, 1993.

* cited by examiner

*Primary Examiner* — Christopher Verdier
(74) *Attorney, Agent, or Firm* — Carlson, Gaskey & Olds, PC

(57) ABSTRACT

A compressor disk for a turbine engine includes a plurality of blades mounted about the circumference. To assemble the blades onto the disk a lock assembly is inserted within a blade slot on the disk. A blade is assembled into the blade slot and slider seals are inserted between the blade and the disk to limit air from entering the blade slot. Additional blades are assembled until the end of the slider seals are reached. The process is repeated until all the blades have been assembled onto the disk. After the last blade has been assembled a spacer seal is placed at each lock assembly to take up the slack. Once all the blades and spacer seals are assembled the lock assemblies can be moved to a locked position.

16 Claims, 7 Drawing Sheets

ROTOR DISK AND BLADE ARRANGEMENT

BACKGROUND OF THE INVENTION

The invention generally relates to an arrangement for loading and locking rotor blades for a rotor.

Turbine engines include high and low pressure compressors to provide compressed air for combustion within the engine. Each compressor typically includes a rotor disk including multiple blades mounted on the disk. Seals are typically located between the disk and the blades to limit the recirculation of air. The disks typically have at least one loading slot for assembly of the blades into a blade slot within the disk and locking slot for preventing movement of the blades relative to the rotor disk once assembled.

During operation the rotor disk is repeatedly heated and cooled placing compressive and tensile forces on the outer portion of the disk. The cyclic loading from the thermal cycles fatigue the disk. Any areas of concentrated stress on the disk are prone to cracking as a result of the fatigue. Eliminating areas of stress concentration, such as the loading and locking slot, increases the durability of the rotor. Any loading arrangement must also prevent blade movement relative to the disk.

An improved arrangement for loading and locking blades on a rotor disk without requiring a loading and locking slot is needed.

SUMMARY OF THE INVENTION

An example compressor disk for a turbine engine according to this invention includes an arrangement for loading blades on a compressor disk without requiring loading slots or locking slots.

A typical compressor has multiple disks, with each disk including a plurality of blades mounted about a circumference. To begin assembly of the blades onto the disk a lock assembly is inserted within a blade slot on the disk. At least one blade is assembled into the blade slot. A neck and a dovetail of the blade are inserted within the blade slot, then the blade is rotated 90-degrees. The dovetail interferes with the blade slot to prevent removal of the blade from the blade slot. Sliders seals are then inserted on each side of the blade slot, between the blade and the disk to limit air from entering the blade slot. Additional blades are assembled, until the end of the slider seals are reached. The additional blades are assembled such that the slider seals are located between the blades and the disk. Once an end of the slider seals is reached another lock assembly is inserted into the blade slot. The above process of inserting a blade, then slider seals, followed by additional blades to reach the end of the slider seals is repeated until all the blades have been assembled onto the disk.

Slack is left between each of the adjacent slider seals to provide enough room for the last blade to be assembled. After the last blade has been assembled a spacer seal is placed across the blade slot at the location of each lock assembly to take up the slack. After all of the lock assemblies, slider seals, blades and spacer seals are in place the lock assemblies can be moved from the released position, to a locked position. A set screw on each lock assembly is tightened to move the lock assembly into the lock position. The lock assemblies each include a rounded end of the set screw to interfit with a depression in the bottom of the blade slot to prevent rotation of the lock assembly.

These and other features of the present invention can be best understood from the following specification and drawings, the following of which is a brief description.

DETAILED DESCRIPTION OF THE PREFERRED EMBODIMENT

Figure 1:
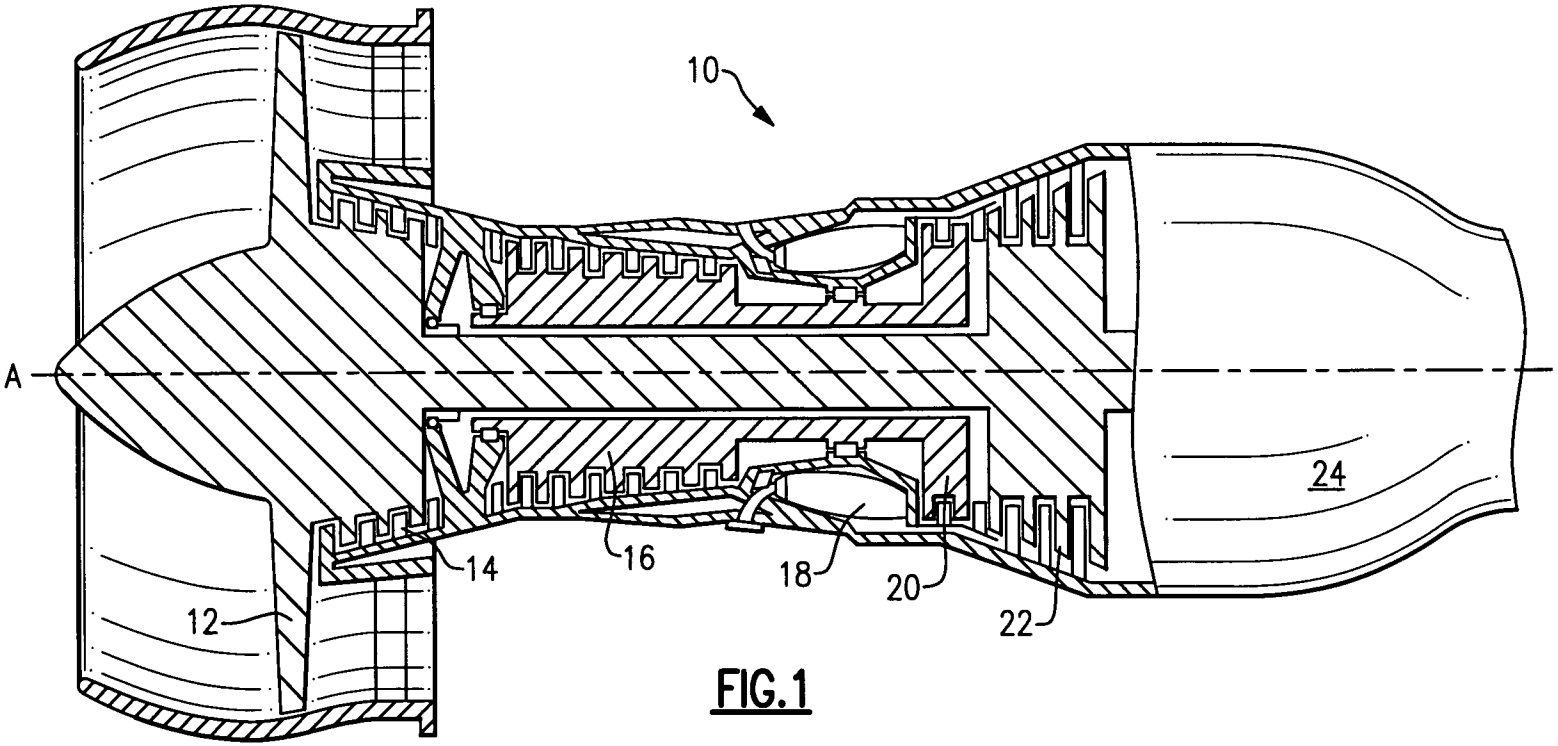
FIG. 1 is a schematic view of an example turbine engine of the present invention.

FIG. 1 is a schematic view of a turbine engine 10. Air is pulled into the turbine engine 10 by a fan 12 and flows through a low pressure compressor 14 and a high pressure compressor 16. Fuel is mixed with the oxygen and combustion occurs within the combustor 18. Exhaust from combustion flows through a high pressure turbine 20 and a low pressure turbine 22 prior to leaving the engine through the exhaust nozzle 24.

Figure 2:
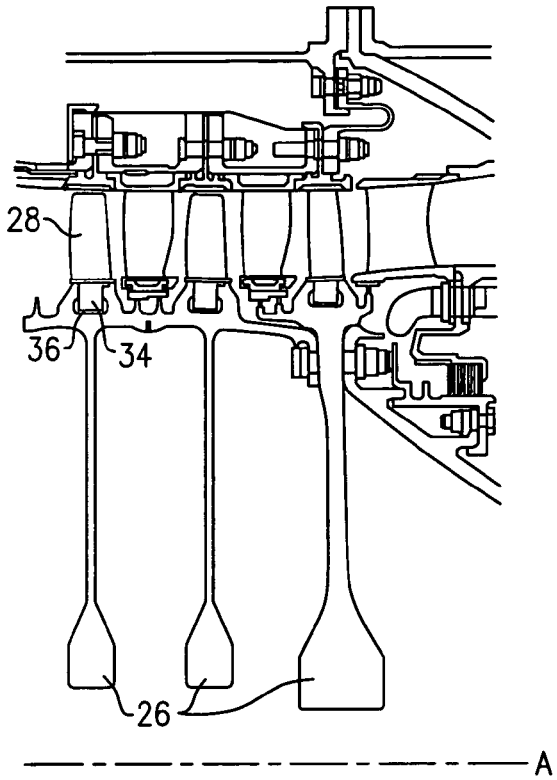
FIG. 2 illustrates a portion of a cross-section of a typical compressor for the example turbine engine of the present invention.

FIG. 2 illustrates a portion of a cross-section of a typical compressor. The low pressure compressor 14 and the high pressure compressor 16 include multiple disks 26. Each disk 26 rotates about an axis A located along the centerline of the turbine engine 10. A plurality of blades 28 are mounted about the circumference of the disk 26.

Figure 3:
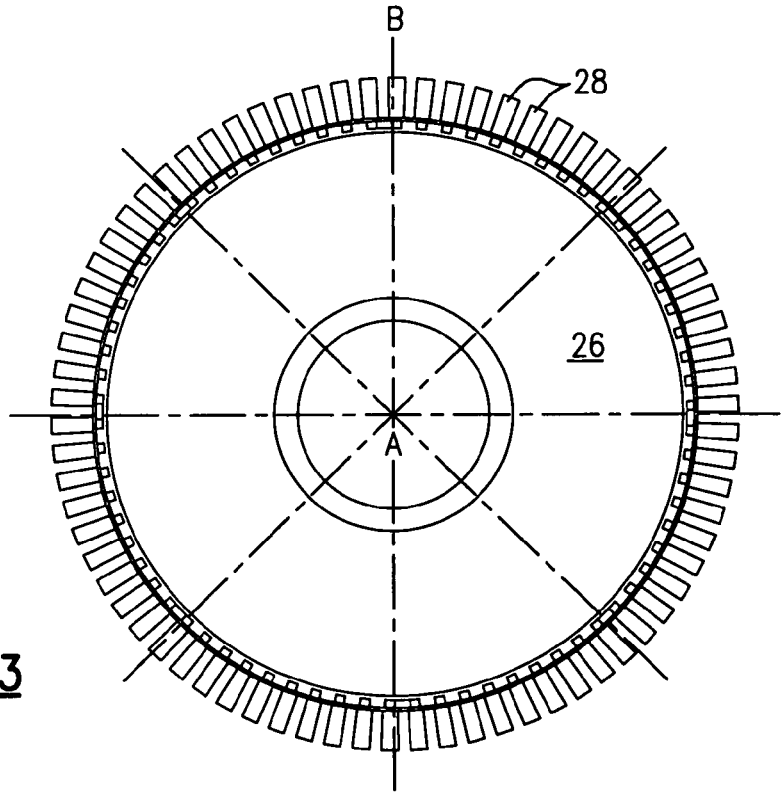
FIG. 3 is an example compressor disk and blade assembly.
Figure 4:
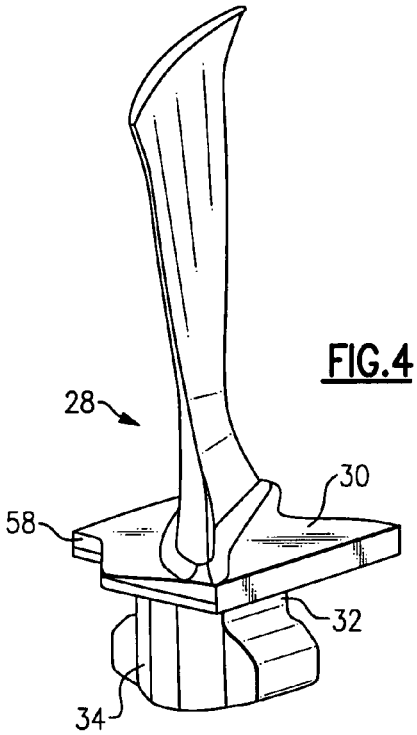
FIG. 4 is a perspective view of an example blade for the example compressor.
Figure 5:
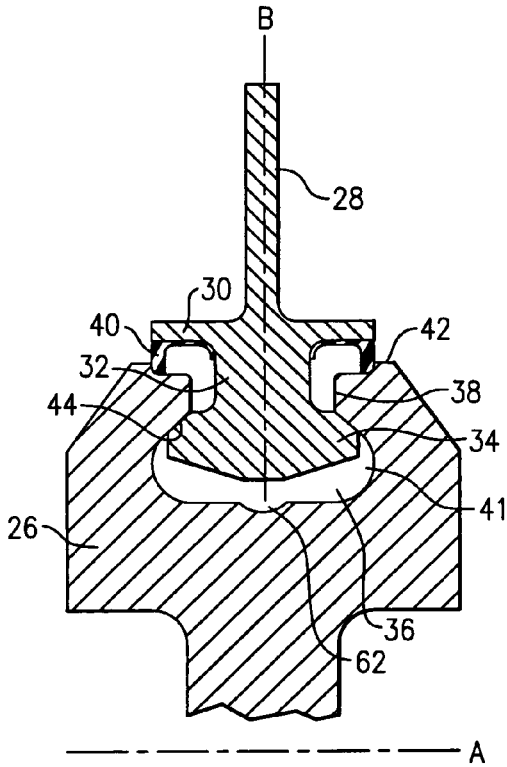
FIG. 5 is a cross-sectional side elevation view of the example disk showing the example blade and a blade slot within the disk.

Referring to FIG. 3 an example disk 26 having blades 28 assembled thereon is shown. FIG. 4 illustrates an example blade 28 prior to assembly with the disk 26. The blade 28 includes a platform 30. A neck 32 extends from the platform 30 and a dovetail 34 extends from the neck 32. FIG. 5 shows a portion of a cross-section of the disk 26 and blade 28 assembly through one of the blades 28. The disk 26 includes a blade slot 36. The blade slot 36 has a slot neck 38 that is narrower then a slot body 41. Slot rails 42 are located on the disk 26 on opposing sides of the blade slot 36. The neck 32 and dovetail 34 of the blade 28 are located within the blade slot 36. The dovetail 34 fits within the slot body 41 and the slot neck 38 interferes with the dovetail 34 to prevent removal of the blade 28 from the slot 36.

Slider seals 40 are located between a radially inner face on the blade 28 and a radially outer face of the disk 26. A slider seal 40 is placed along the slot rail 42 on each side of the blade slot 36. The platform 30 contacts one portion of the slider seal 40 and the disk 26 contacts an opposing portion of the slider seal 40. The slider seals 40 limit air from entering between the blade 28 and the disk 26 into the blade slot 36. The slider seals 40 provide improved leakage protection over the prior art design and reduce the number of seals for each disk 26.

Figure 6:
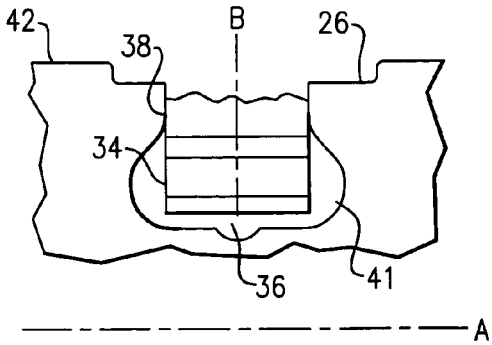
FIG. 6 is a cross-sectional side elevation view of the example disk showing the example blade inserted within the blade slot prior to rotation into an assembled position.

To assemble the blade 28 within the blade slot 36 the neck 32 and dovetail 34 are inserted within the blade slot 36 past a slot neck 38, as shown in FIG. 6. The blade 28 is then rotated 90-degrees about a blade axis B, perpendicular to a slot axis of the blade slot 36 to arrive at the orientation shown in FIG. 5. Once rotated, the dovetail 34 is prevented from movement past the slot neck 38, as shown. Pressure faces 44 on the dovetail 34 provide a surface for contacting the disk 26.

Figure 7:
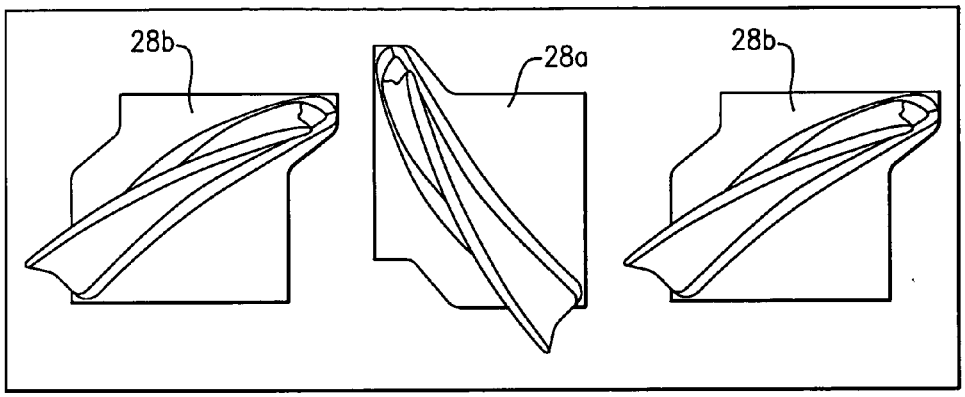
FIG. 7 is a radially inward view of a plurality of the example blades with the blade slot.

FIG. 7 illustrates blades 28 within the blade slot 36, where one blade 28*a* has been inserted and not yet rotated. Blades 28*b* are inserted within the blade slot 36 and rotated in position. The platforms 30 on the blades 28 are shaped to allow rotation of the blades 28, and fit together once rotated in position.

Figure 8:
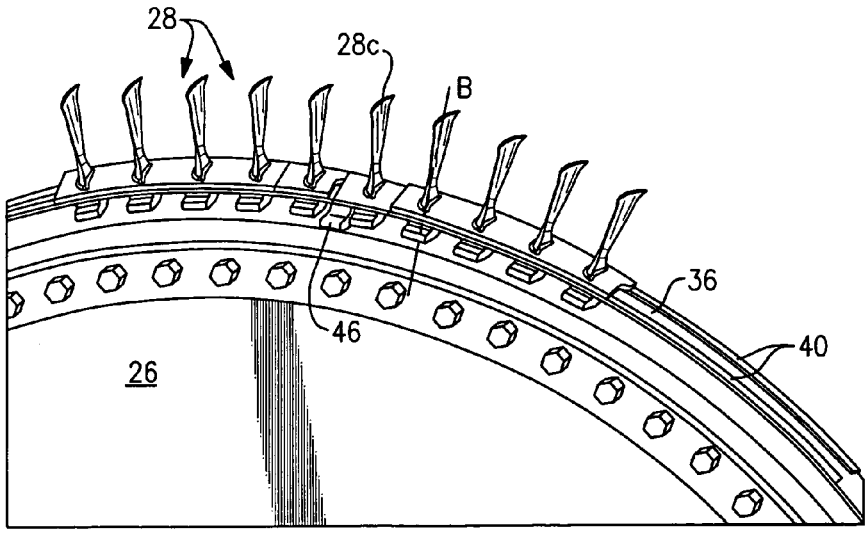
FIG. 8 illustrates a portion of the disk with a plurality of blades assembled on the disk.
Figure 9:
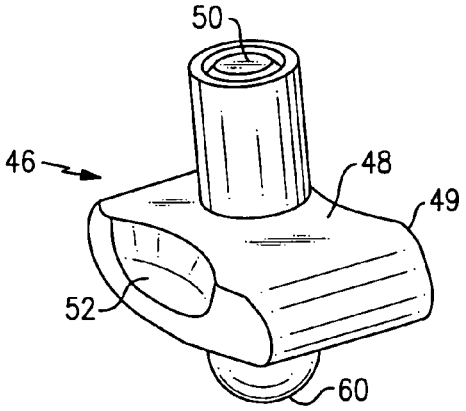
FIG. 9 is a perspective view of an example lock assembly for the example compressor.

Referring to FIGS. 8-10 an example assembly process of the blades 28 onto the disk 26 is illustrated. A lock assembly 46 is inserted substantially within the blade slot 36. The lock assembly 46, shown in FIG. 9, includes a lock housing 48 and a set screw 50. The lock assembly 46 is assembled in a similar manner to the blade 28. That is, the lock assembly 46 is inserted past the slot neck 38 and rotated 90-degrees about the blade axis B, perpendicular to the slot axis. After the lock assembly 46 is rotated within the blade slot 36 the lock housing 48 interferes with and is prevented from movement past the slot neck 38. The lock housing 48 has pressure faces 49 to provide a surface for contacting the disk 26. During insertion of the lock assembly 46 and the blades 28 into the blade slot 36 the lock assembly 46 remains in a released position.

Figure 10A:
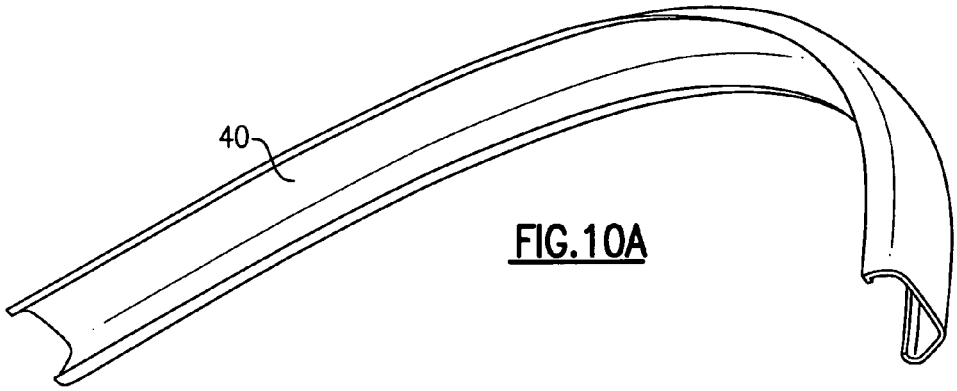
FIG. 10A is a perspective view of an example slider seal for the example compressor.
Figure 10B:
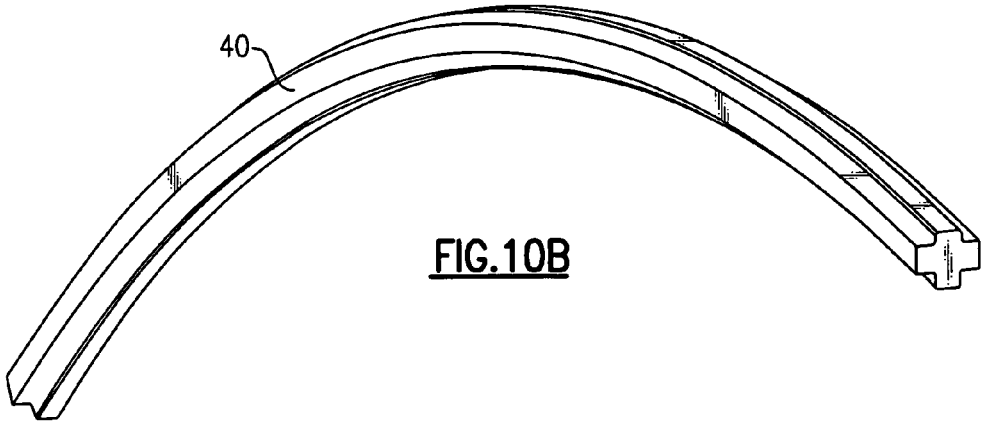
FIG. 10B is a perspective view of another example slider seal for the example compressor.

Once the lock assembly 46 is assembled into the blade slot 36 at least one blade 28*c* is assembled into the blade slot 36, as described above. Sliders seals 40, shown in FIG. 10A, are then inserted on each side of the blade slot 36 between the blade 28 and the disk 26. Additional blades 28 are assembled onto the disk 26 such that the slider seals 40 are located between the blades 28 and the disk 26. That is, the slider seals extend circumferentially beyond plural blades. The slider seals can be seen to be at axial ends of the blades defined along axis A. Additional blades 28 are assembled, until the end of the slider seals 40 are reached. Alternatively, the slider seals 40 are configured as shown in FIG. 10B. In this example, the disk 26 includes a groove to retain the sliders seals 40 on each side of the blade slot 36. The blades 28 also include a groove to assist in retention of the slider seals 40 against the blade 40 and to prevent ingress of air.

Once the end of the slider seals 40 are reached another lock assembly 46 is inserted into the blade slot 36. Thus, a lock assembly 46 is located at each end of the slider seals 40. The above process of inserting a blade 28, then slider seals 40, followed by additional blades 28 to reach the end of the slider seal 40 is repeated. Once again a lock assembly 46 is inserted and the process repeated until all the blades 28 have been assembled onto the disk 26. Upon completion of inserting blades 28 into the blade slot 36, a lock assembly 46 is located between each circumferentially adjacent slider seals 40. In one example, there are eight lock assemblies 46 and eight sets of slider seals 40. The number of lock assemblies 46 and the number and length of the sliders seals 40 may vary. One skilled in the art would be able to determine the appropriate numbers and lengths of blades 28, slider seals 40 and lock assemblies 46.

Slack is left between each of the circumferentially adjacent slider seals 40 to provide enough room for the last blade 28 to be assembled. That is, to provide enough space to insert and then rotate the last blade 28 into position, the already assembled blades 28 and the slider seals 40 may be all pushed together, eliminating the slack. After the last blade 28 has been assembled some of the slack remains between each of the circumferentially adjacent slider seals 40. Additionally, each lock assembly 46 includes scallop 52 in the housing 48. The scallop 52 provides space for the dovetail 34 of the blades 28 to overlap the lock assembly 46 to provide additional slack during assembly of the final blade 28.

Figure 12:
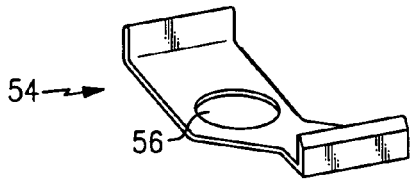
FIG. 12 is a perspective view of the example spacer seal for the example compressor.
Figure 11:
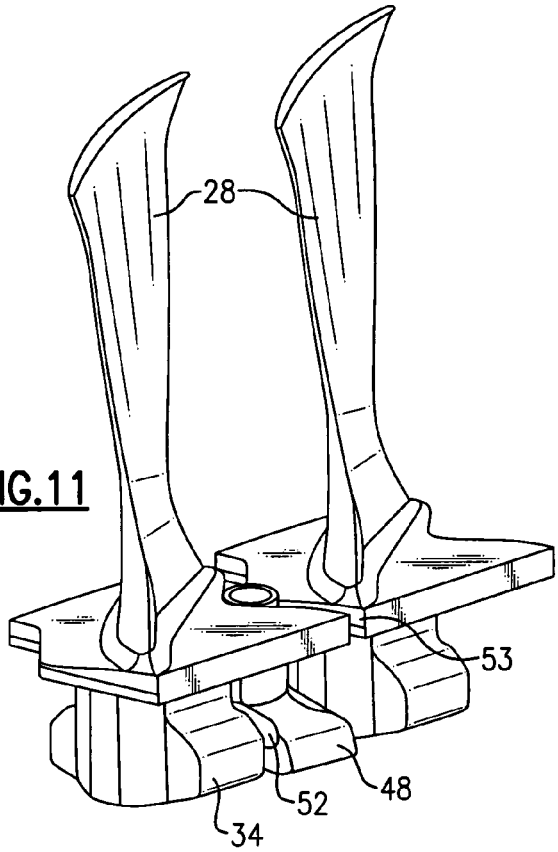
FIG. 11 illustrates a portion of the disk with a plurality of blades assembled on the disk showing slack between the plurality of blades prior to assembled of a spacer seal.
Figure 13:
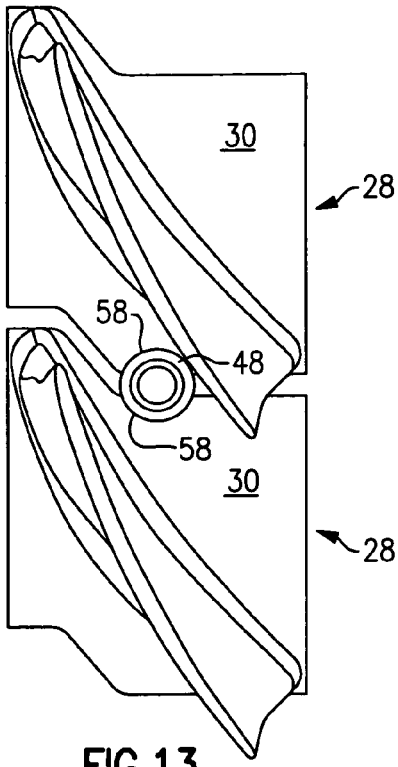
FIG. 13 is a top view of a plurality of blades, the spacer seal, and the lock assembly assembled on the disk.
Figure 14:
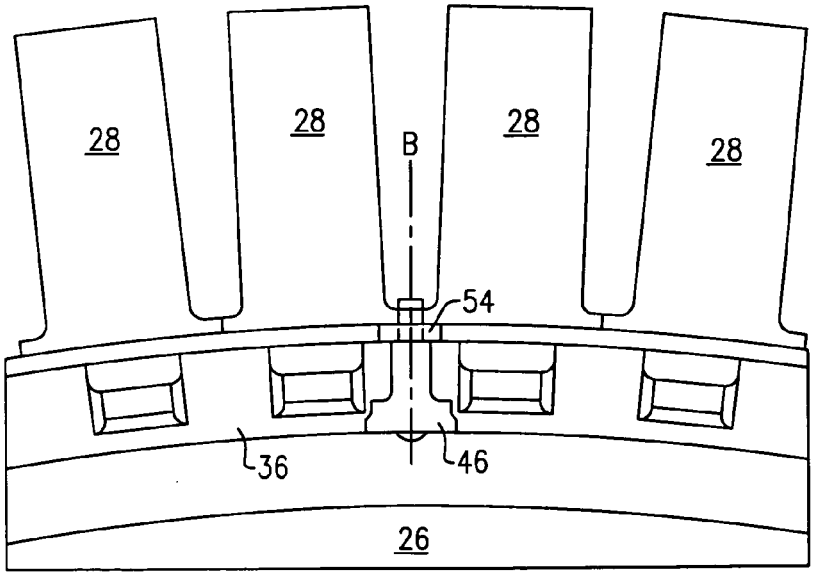
FIG. 14 is a side view of a plurality of blades, the spacer seal, and the lock assembly assembled on the disk.

Referring to FIGS. 11-14, once all the blades 28 have been assembled the slack used for assembly of the final blade 28 must be reduced to prevent the blades 28 from shifting and rotating during operation. FIG. 11 illustrates the slack 53 that remains between sliders seals 40 after assembly of the blades 28. A spacer seal 54, shown in FIG. 12, is placed between the slot rails 42 across the blade slot 36 at the location of each lock assembly 46. The spacer seal 54 defines a through hole 56 to allow the housing 48 of the lock assembly 46 to extend through. The slack used to assemble the final blade 28 is taken up once all the spacer seals 54 are in place, as shown in FIGS. 13 and 14. To provide the most efficient fit possible, the blades 28 located on each side of the lock assemblies 46 have a lock interfitting portion 58. The lock interfitting portion 58 has a complementary shape to the portion of lock housing 48 which contacts the blades 28. Any slack remaining is spread equally among each of the lock assemblies 46 and acts as a thermal gap to prevent the platforms 30 of the blades 28 from buckling during operation. In addition to reducing the slack, the spacer seals 54 limit air from entering between the blades 28 and the disk 26 into the blade slot 36.

Figure 16:
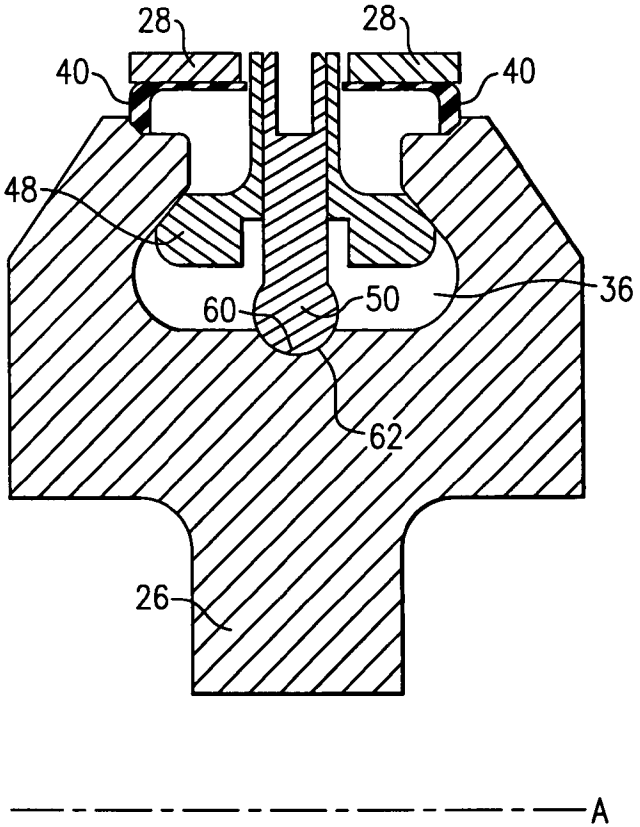
FIG. 16 is a cross-sectional side elevation view of the example disk showing the example lock assembly in a locked position.
Figure 15:
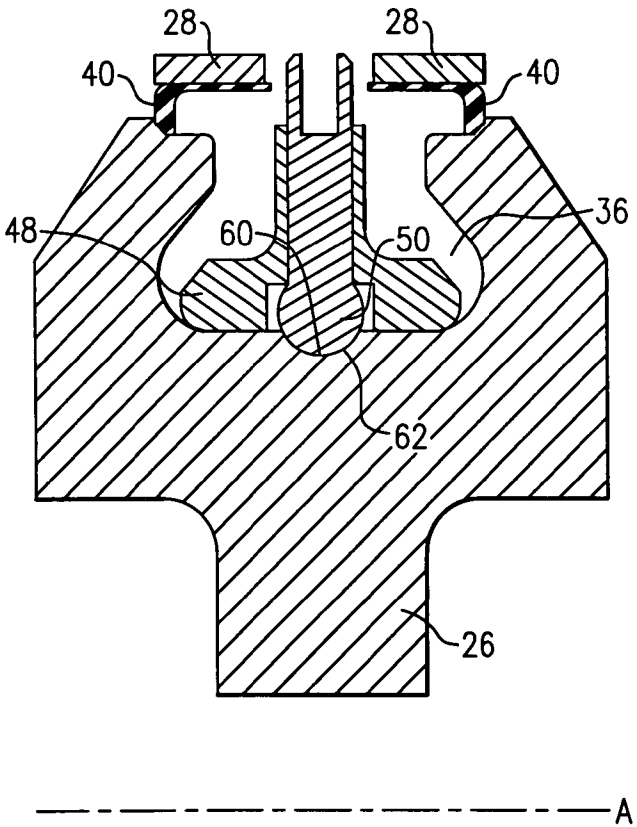
FIG. 15 is a cross-sectional side elevation view of the example disk showing the example lock assembly in a released position.

After all of the lock assemblies 46, slider seals 40, blades 28 and spacer seals 54 are in place the lock assemblies 46 can be moved from the released position, FIG. 15, to the locked position. The set screw 50 on each lock assembly 46 is tightened moving the lock assembly 46 into the lock position shown in FIG. 16. The lock assemblies 46 each include a first interlocking feature 60 and the blade slot 36 includes a second interlocking feature 62. When the lock assemblies 46 are in the lock position the first interlocking feature 60 and the second interlocking feature 62 lock together to prevent rotation of the lock assembly 46. In the example shown the first interlocking feature 60 is a rounded end of set screw 50 and the second interlocking feature 62 is at least one depression or indentation in the disk 26 at the bottom of the blade slot 36.

Although the example embodiment discloses arrangement of assembling blades onto a rotor disk for a compressor the arrangement may be used for any disk and blade assembly and is not limited to a compressor. The lock assemblies 46, slider seals 40, blades 28 and spacer seals 54 have a negligible difference in weight over prior art designs and decrease the number of seals required for each disk while reducing the stress concentrations on the disk 26 and blade 28 assembly.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A compressor comprising:

a rotor disk centered on an axis and defining a blade slot;

a plurality of blades each having a portion located within the blade slot;

a plurality of sets of slider seals located radially between the plurality of blades and the rotor disk and said sets being on opposed axial sides of the plurality of blades, the slider seals extending circumferentially beyond plural ones of said plurality of blades;

a plurality of spacer seals located between ends of the plurality of sets of slider seals; and a plurality of lock assemblies, each lock assembly associated with one of the plurality of spacer seals.

2. The compressor of claim 1, wherein a slot rail is located on each axial side of the blade slot and one slider seal in each of the plurality of sets of slider seals is associated with one of the slot rails.

3. The compressor of claim 2, wherein each of the plurality of slider seals are located radially between the blades and the slot rails.

4. The compressor of claim 2, wherein each of the plurality of spacer seals extend axially across the blade slot between the slot rails.

5. The compressor of claim 1, wherein each of the plurality of lock assemblies comprises a housing and a set screw movable between a load position and a lock position, and the lock assembly is located substantially within the blade slot.

6. The compressor of claim 5, wherein each of the plurality of spacer seals includes a through hole and the housing of the lock assembly extends through the through hole and contacts adjacent blades when the lock assembly is in the lock position.

7. The compressor of claim 5, wherein the set screw includes a first interlocking feature and the blade slot includes a second interlocking feature and the first interlocking feature locks with the second interlocking feature when the lock assembly is in the lock position.

8. A turbine engine component comprising:

a disk including a pair of slot rails located on opposing sides of a blade slot, and to be mounted for rotation about an axis of a turbine engine;

a first plurality of blades each having a portion located within the blade slot, wherein a first pair of slider seals are located radially between the first plurality of blades and the slot rails, the first pair of slider seals extending circumferentially across an extent of the first plurality of blades;

a second plurality of blades each having a portion located within the blade slot, wherein a second pair of slider seals are located between the second plurality of blades and the slot rails, the second pair of slider seals extending circumferentially across an extent of the second plurality of blades;

a first spacer seal located between the first pair of slider seals and the second pair of slider seals;

a first lock assembly located in the blade slot and associated with the first spacer seal;

a third plurality of blades each having a portion located within the blade slot, wherein a third pair of slider seals are located between the third plurality of blades and the disk rails;

a fourth plurality of blades each having a portion located within the blade slot, wherein a fourth pair of slider seals are located between the fourth plurality of blades and the disk rails;

a second spacer seal located between the second pair of slider seals and the third pair of slider seals, a third spacer seal located between the third pair of slider seals and the fourth pair of slider seals, a fourth spacer seal located between the fourth pair of slider seals and the first pair of slider seals; and a second lock assembly located in the blade slot and associated with the second spacer seal, a third lock assembly located in the blade slot and associated with the third spacer seal, and a fourth lock assembly located in the blade slot and associated with the fourth spacer seal.

9. The component of claim 8, wherein the first spacer seal extends axially across the blade slot.

10. The component of claim 8, wherein the first lock assembly comprises a housing and a set screw.

11. A turbine engine component comprising:

a disk including a pair of slot rails located on opposing sides of a blade slot, and to be mounted for rotation about an axis of a turbine engine;

a first plurality of blades each having a portion located within the blade slot, wherein a first pair of slider seals are located radially between the first plurality of blades and the slot rails, the first pair of slider seals extending circumferentially across an extent of the first plurality of blades;

a second plurality of blades each having a portion located within the blade slot, wherein a second pair of slider seals are located between the second plurality of blades and the slot rails, the second pair of slider seals extending circumferentially across an extent of the second plurality of blades;

a first spacer seal located between the first pair of slider seals and the second pair of slider seals;

a first lock assembly located in the blade slot and associated with the first spacer seal;

the first lock assembly comprises a housing and a set screw; and wherein the first spacer seal includes a through hole and the housing of the first lock assembly extends through the through hole and contacts one blade from the first plurality of blades and one blade from the second plurality of blades when the first lock assembly is in a lock position.

12. The component of claim 8, wherein the disk comprises a compressor disk.

13. A method of assembling a compressor comprising:

a) placing a first lock assembly in a blade slot located in a rotor disk, the rotor disk centered on an axis;

b) inserting a first blade in the blade slot adjacent to the first lock assembly;

c) placing a first slider seal radially between the first blade and a first wall of the blade slot and placing a second slider seal radially between the first blade and an axially opposing wall of the blade slot;

d) inserting a second blade in the blade slot such that the first slider seal and the second slider seal are located between the second blade and the rotor disk;

e) repeating said steps a) through d) until a plurality of blades are inserted in the blade slot until ends of the first and second slider seals are reached then repeating steps a) through c) such that a lock assembly is located between each circumferentially adjacent first and second slider seal;

f) placing a spacer seal across the blade slot at each lock assembly location; and g) locking the lock assemblies.

14. The method as set forth in claim 13, wherein said steps a) through e) occur before step f) and g).

15. A component for a disk and blade assembly comprising:

a lock housing defining at least one indentation for receiving a portion of a blade;

a lock portion supported by the lock housing and moveable relative to the lock housing between a lock position and a released position, said lock portion for being positioned between circumferentially adjacent blades, such that said lock portion is between two blades, and retains said blades on a disk when in the lock position.

16. The component of claim 15, wherein the lock portion comprises a set screw.

* * * * *